United States Patent [19]

McChesney et al.

[11] 4,194,483

[45] Mar. 25, 1980

[54] AUTOMATIC FUEL PRIMING SYSTEM

[75] Inventors: Richard M. McChesney, Waukegan; Robert K. Turner, Zion, both of Ill.

[73] Assignee: Outboard Marine Corporation, Waukegan, Ill.

[21] Appl. No.: 835,417

[22] Filed: Sep. 21, 1977

[51] Int. Cl.[2] ..... F02M 1/16

[52] U.S. Cl. ..... 123/187.5 R; 123/179 G; 123/DIG. 5

[58] Field of Search ..... 123/179 G, DIG. 5, 187.5 R, 123/139 A, 73 A; 261/DIG. 68

[56] References Cited

U.S. PATENT DOCUMENTS

| | | | |
|---|---|---|---|
| 2,656,828 | 10/1953 | Conover | 123/DIG. 5 |
| 2,713,854 | 7/1955 | Conover | 123/DIG. 5 |
| 3,045,605 | 7/1962 | Nutton et al. | 123/DIG.5 |
| 3,160,682 | 12/1964 | Carlson et al. | 123/DIG.5 |
| 3,548,796 | 12/1970 | Gastinne | 123/187.5 R |
| 3,767,173 | 10/1973 | Ishii | 123/179 G |
| 3,800,754 | 4/1974 | Carlson et al. | 123/DIG.5 |
| 3,805,758 | 4/1974 | May | 123/187.5 R |
| 3,978,839 | 9/1976 | DuBois et al. | 123/187.5 R |
| 3,987,775 | 10/1976 | O'Connor | 123/DIG. 5 |

*Primary Examiner*—Ira S. Lazarus

[57] ABSTRACT

Disclosed herein is an internal combustion engine including a combustion chamber, a fuel source, a starter mechanism, fuel conduit means connected in communication with the fuel source for introducing fuel into the combustion chamber, fuel pumping means connected in communication with the fuel conduit means and operable for pumping fuel through the fuel conduit means, drive means for operating the fuel pumping means, and means for operatively connecting the drive means with the fuel pumping means when the starter mechanism is activated to thereby prime the engine.

14 Claims, 2 Drawing Figures

AUTOMATIC FUEL PRIMING SYSTEM

BACKGROUND OF THE INVENTION

The invention relates to internal combustion engines and, more particularly, to primer systems for internal combustion engines.

Engines are sometimes difficult to start when they are cold or after they have been sitting inoperative for a period of time. To facilitate starting, conventional priming systems employ means that operate independently of engine operation for pumping a quantity of primer fuel into the combustion chamber. Representative examples of prior art priming systems are disclosed in the following U.S. Patents and Patent Application:

Wynne et al. U.S. Pat. No. 2,271,383, Jan. 27, 1942,
Howell U.S. Pat. No. 2,945,483, July 19, 1960,
Schlagmuller et al. U.S. Pat. No. 3,614,945, Oct. 26, 1971,
DuBois et al. U.S. Pat. No. 3,978,839, Sept. 7, 1976,
Turner Application Ser. No. 723,818, Filed Sept. 16, 1976.

SUMMARY OF THE INVENTION

The invention provides a fuel priming system for an engine including a starter mechanism, which priming system is operated when the starter mechanism is activated.

More specifically, the invention provides an engine including a combustion chamber, a source of pulsating pressure, a fuel source, and a starter mechanism. The engine further includes fuel conduit means connected in communication with the fuel source for introducing fuel into the combustion chamber, fuel pumping means connected in communication with the fuel conduit means and operable for pumping fuel through the fuel conduit means in response to pulsating pressure, pulse conduit means connecting the fuel pumping means in communication with the source of pulsating pressure, valve means connected in communication with the pulse conduit means for controlling the admission of the pulsating pressure to the fuel pumping means, and means for selectively operating the valve means when the starter mechanism is activated.

In accordance with one embodiment of the invention, the starter mechanism includes a starter gear, a rotatable starter shaft, mechanical or electrical means for rotating the starter shaft, a starter pinion carried on the starter shaft for movement relative to the starter shaft and movable between a retracted position spaced from the starter gear and an engaged position in mesh with the starter gear, and activating means operatively connecting the starter pinion with the valve means for opening the valve means in response to movement of the starter pinion toward the engaged position and for permitting closing of the valve means in response to movement of the starter pinion toward the retracted position.

In accordance with another embodiment of the invention, the valve means includes a slide valve including a plunger movable between open and closed positions, means for biasing the plunger toward the closed position, and the activating means includes a pivotally mounted lever having one portion located to be engaged by the starter pinion and another portion located to engage the plunger.

In accordance with another embodiment of the invention, the engine includes a cylinder defining a combustion chamber, a piston mounted in the cylinder for reciprocative movement therein, a crankcase extending from the cylinder and forming the source of pulsating pressure in response to reciprocation of the piston, the fuel pumping means includes a carburetor having a diaphragm defining a pulse chamber and a fuel chamber, and the pulse conduit means connects the pulse chamber in communication with the crankcase.

One of the principal features of the invention is the provision of a simplified fuel priming system to facilitate starting of an engine, which priming system includes means for selectively delivering a quantity of primer fuel into the combustion chamber, in response to pressure variations in the engine crankcase, as the engine is being started.

Another of the principal features of the invention is the provision of an engine including means activated by the starter mechanism of the engine for selectively pumping primer fuel into the engine.

Still another object of the principal features of the invention is the provision of a fuel priming system for an engine, which priming system requires minimum modification to existing engine construction.

Other features and advantages of the embodiments of the invention will become apparent upon reviewing the following general description, the drawings and the appended claims.

Figure 1:
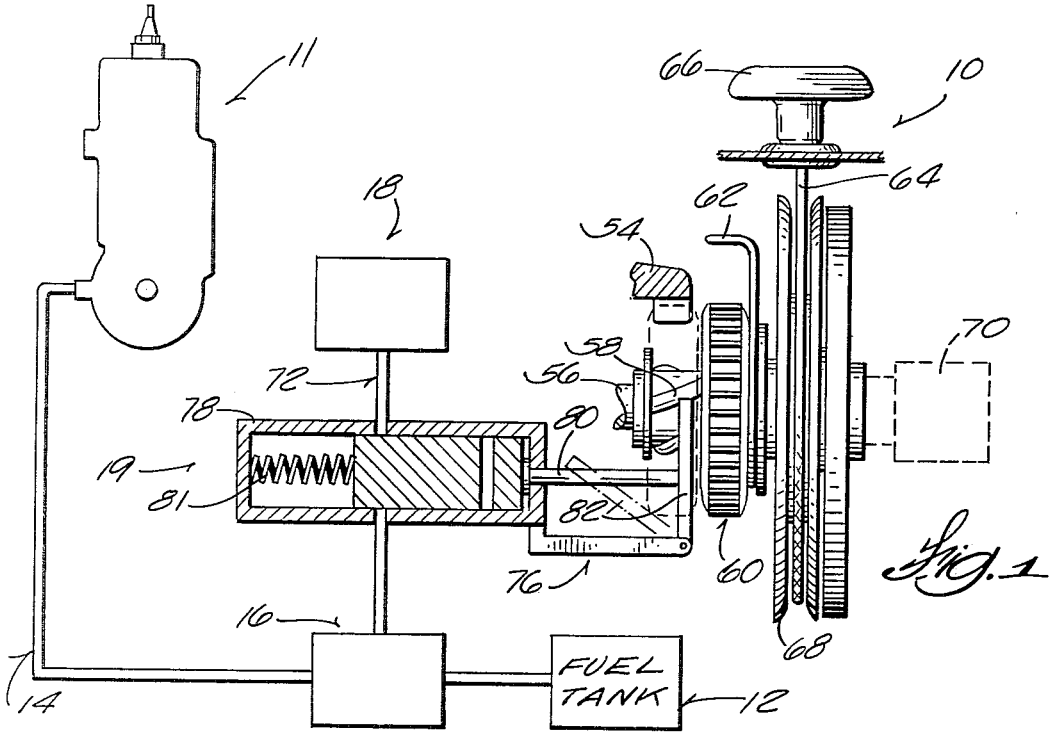
FIG. 1 is a fragmentary and partially diagramatic view of an internal combustion engine embodying various of the features of the invention.

Before explaining the invention in detail, it is to be understood that the invention is not limited in its application to the details of construction in the arrangement of components set forth in the following description or illustrated in the drawings. The invention is capable of other embodiments and of being practiced and carried out in various ways. Also, it is to be understood that the phraseology and terminology employed herein for the purpose of description should not be regarded as limiting.

GENERAL DESCRIPTION

Shown in FIG. 1 is an internal combustion engine including a starter mechanism 10, a combustion chamber 11, a source of fuel 12, and fuel conduit means 14 connected in communication with the fuel source 12 for introducing fuel into the combustion chamber 11. The engine further includes fuel pumping means 16 connected in communication with the fuel conduit means 14 and operable for pumping fuel through the conduit means 14, and drive means 18 for operating the fuel pumping means 16. In accordance with the invention, the engine includes means 19 for connecting the drive means 18 with the fuel pumping means 16 when the starter mechanism 10 is activated, so that a quantity of priming fuel is pumped into the combustion chamber 11 when the starter mechanism 10 is activated.

Figure 2:
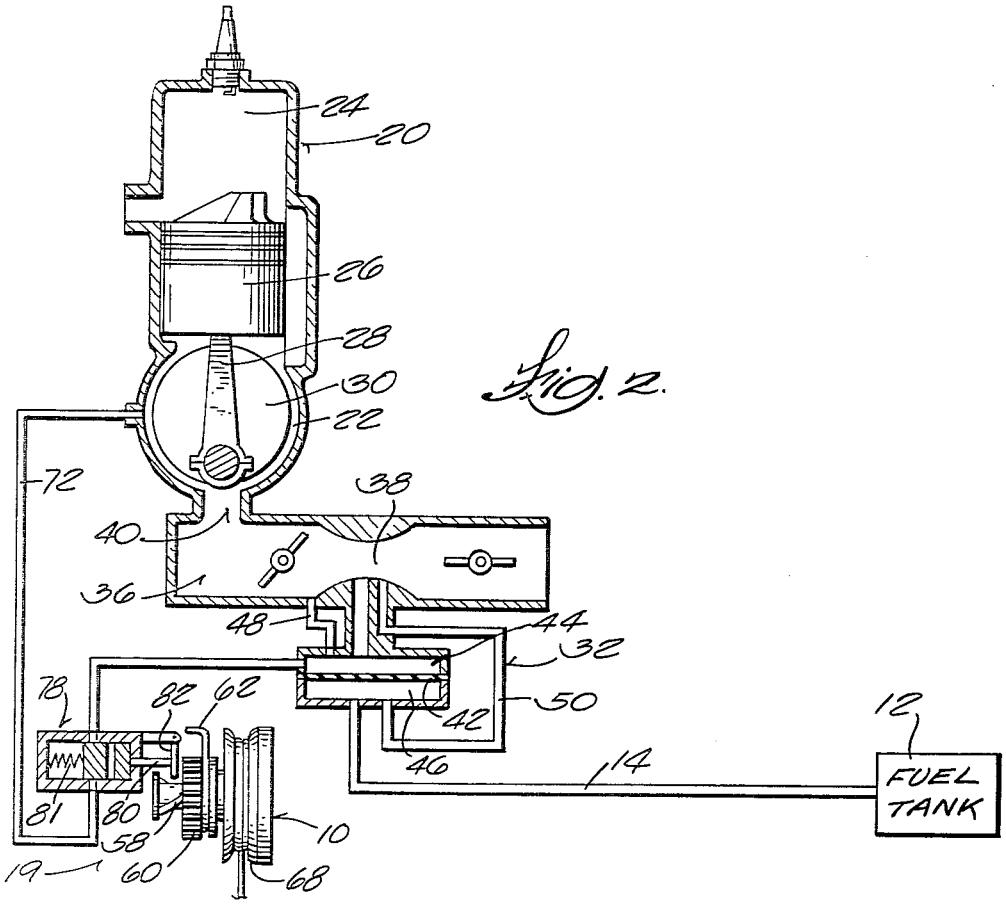
FIG. 2 is a view similar to FIG. 1 except the engine includes a diaphragm-type carburetor.

While various engine constructions can be used, the engine illustrated in FIG. 2 includes a block member 20 defining a crankcase 22 and a cylinder 24 extending from the crankcase 22. A piston 26 is mounted for reciprocative movement inside the cylinder 24 and is connected by a connecting rod 28 to a crankshaft 30 rotatably mounted in the crankcase 22. The reciprocative movement of the piston 26 in the cylinder 24 creates a series of pulsating pressure variations in the crankcase 22.

The engine illustrated in FIG. 2 also includes a conventional aspirated diaphragm-type carburetor 32 having an air induction passage 36, a Venturi 38, and an air-fuel induction port 40 connected in communication with the crankcase 22. A diaphragm 42 defines a pulse chamber 44 and a fuel chamber 46. The pulse chamber 44 is connected in communication with the crankcase 22 through the air induction passage 36 and a pulse chamber conduit 48. The diaphragm 42 oscillates in response to pressure variations created in the crankcase 22 by reciprocation of the piston 26, and thereby pumps fuel from the fuel chamber 46 into the Venturi 38 through suitable conduit means 50.

While various suitable arrangements can be used, in the specific construction illustrated in FIG. 1, the starter mechanism 10 includes a starter gear 54 and a rotatable starter shaft 56 including a drive worm 58 carrying a starter pinion 60. The starter pinion 60 is frictionally restrained by a drag spring 62 so that, when the starter shaft 56 (and thus the drive worm 58) is rotated, the starter pinion 60 moves axially on the drive worm 58 from a retracted position spaced from the starter gear 54 to an engaged position in mesh with the starter gear 54 as illustrated by dotted lines FIG. 1. Rotation of the starter gear 54 cranks the engine.

The starter mechanism 10 is manually actuated and includes a pull rope 64 which is wound up on a pully 68 connected to the starter shaft 56 and has a pull handle 66. When the pull rope 64 is pulled, the starter shaft 56 and the drive worm 58 rotate. Alternately, the starter shaft 56 can be rotated for starting by an electric motor 70 (diagramatically illustrated by dashed lines in FIG. 1) operatively connected to the starter shaft 56.

When the engine is cold or has been inoperative for some time, it is often necessary to crank the engine for an extended period of time in order for a sufficient quantity of fuel to be pumped into the cylinder 24 in response to pressure variations in the air induction passage 36 to initiate combustion. To facilitate starting, conventional priming systems supplement the normal delivery of fuel during starting by pumping priming fuel into the cylinder 24 with a pumping mechanism (not shown) which operates independently of normal engine operation, such as a manually operated hand pump.

The pulse chamber 44 is connected in communication with the crankcase 22 by a pulse conduit 72. Pressure variations in the crankcase 22 are thereby communicated directly to the pulse chamber 44 through the pulse conduit 72 and have a more pronounced effect on the diaphragm 42 than pressure variations normally communicated more indirectly to the pulse chamber 44 through the air induction passage 36.

The invention is equally applicable in an engine (not illustrated) having a conventional bowl-type carburetor connected in communication with a pulse-actuated fuel pump having a diaphragm defining a pulse chamber and a fuel chamber. In this construction, the pulse chamber of the fuel pump is connected in communication with the crankcase by a pulse conduit to provide the same operative priming effect as described above.

While various suitable means can be used for selectively connecting the drive means 18 with the fuel pumping means 16 when the starter mechanism 10 is activated, in the embodiment illustrated in FIG. 1, such means comprises a slide valve 78 connected in communication with the pulse conduit 72 and including a plunger 80 which is moved between open and closed positions in response to the movement of the starter pinion 60 by an activating means 76. The slide valve 78 further includes a spring 81 for biasing the plunger 80 toward the closed position. The activating means 76 comprises a pivotally mounted lever 82 located in the travel path of the starter pinion 60 and in engagement with the plunger 80 so that, as the starter pinion 60 moves toward the engaged position, the lever 82 is moved to the dashed line position and moves the plunger 80 to open the slide valve 78. The pulse chamber 44 is then connected in communication with the crankcase 22 through the pulse conduit 72, and the variable crankcase pressure acting on the diaphragm 42 during engine cranking causes a quantity of priming fuel to be pumped into the combustion chamber 24. The engine is thereby primed as it is being cranked. As the starter pinion 60 returns toward the retracted position after starting, the plunger 80 is returned to the closed position and the lever 82 is returned to the solid line position by the spring 81. Thus, the pulse conduit 72 is closed and the engine thereafter operates in the normal manner.

The invention can be adapted for use with different activating means which is operable to initiate pumping of priming fuel into the engine when the starter mechanism is activated and thereby eliminates the need for an independently operated priming means. For example, a foot pedal or suitable push button arrangement (not illustrated) can be used for selectively operating the plunger 80 so that the operator can manually open the slide valve 78 at the same time he actuates the starter mechanism. Likewise, the invention is adaptable for use in an engine having an electrically operated fuel pump. That is, the ignition system can be arranged so that movement of the ignition switch to initiate operation of the starter mechanism simultaneously activates an electrical switch which electrically connects the fuel pump with its source of electrical power. With this arrangement, operation of the fuel pump is initiated at the same time engine cranking is initiated.

Various of the features of the invention are set forth in the following claims.

What is claimed is:

1. An engine comprising a combustion chamber, a source of pulsating pressure, a fuel source, a starter mechanism, fuel conduit means connected in communication with said fuel source for introducing fuel into said combustion chamber, fuel pumping means connected in communication with said fuel conduit means and operable for pumping fuel through said fuel conduit means in response to said pulsating pressure, pulse conduit means connecting said fuel pumping means in communication with said source of pulsating pressure, valve means connected in communication with said pulse conduit means for controlling the admission of said pulsation pressure to said fuel pumping means, and means for selectively operating said valve means when said starter mechanism is activated.

2. An engine comprising a combustion chamber, a source of pulsating pressure, a fuel source, a starter mechanism including a rotatable starter shaft, means for rotating said starter shaft, a starter gear, a starter pinion carried on said starter shaft for movement relative to said starter shaft in response to rotation of said starter shaft between a retracted position spaced from said starter gear and an engaged position in mesh with said starter gear, fuel conduit means connected in communication with said fuel source for introducing fuel into said combustion chamber, fuel pumping means connected in communication with said fuel conduit means and operable for pumping fuel through said fuel conduit means in response to said pulsating pressure, pulse conduit means connecting said fuel pumping means in communication with said source of pulsating pressure, valve means connected in communication with said pulse conduit means for controlling the admission of said pulsating pressure to said fuel pumping means, and activating means connecting said starter pinion with said valve means for opening said valve means in response to movement of said starter pinion toward said engaged position and for permitting closing of said valve means in response to movement of said starter pinion toward said retracted position.

3. An engine according to claim 2 wherein said valve means comprises a slide valve including a plunger movable between open and closed positions and means for biasing said plunger toward the closed position, and wherein said activating means is operably connected to said plunger.

4. An engine according to claim 3 wherein said activating means includes a pivotally mounted lever having one portion located to be engaged by said starter pinion and another portion located to engage said plunger.

5. An engine according to claim 2 wherein said means for rotating said starter shaft includes a pulley member drivingly connected to said starter shaft, a pull rope wound on said pulley member and having one end affixed to said pulley member and having a free end which is pulled to rotate said pulley member and thereby rotate said starter shaft.

6. An engine according to claim 2 wherein said means for rotating said starter shaft includes an electric motor drivingly connected to said starter shaft.

7. An engine according to claim 1 including a cylinder defining said combustion chamber, a piston mounted in said cylinder for reciprocative movement therein, and a crankcase extending from said cylinder and forming said source of pulsating pressure in response to reciprocative movement of said piston.

8. An engine according to claim 7 wherein said fuel pumping means includes a carburetor having a diaphragm defining a pulse chamber and a fuel chamber, and wherein said pulse conduit means connects said pulse chamber in communication with said crankcase.

9. An internal combustion engine comprising a cylinder, a piston mounted in said cylinder for reciprocative movement therein, a crankcase extending from said cylinder and wherein pulsating pressure variations are created by reciprocation of said piston, a starter mechanism having a starter gear and a movable member movable between a retracted position spaced from said starter gear and an engaged position in mesh with said starter gear, a source of fuel, fuel conduit means connected in communication with said fuel source for introducing fuel into said cylinder, fuel pumping means connected in communication with said fuel conduit means and including a carburetor having a diaphragm operable in response to pulsating pressure variations to pump fuel through said fuel conduit means, pulse conduit means connecting said pulse chamber in communication with said crankcase, valve means movable between open and closed positions and connected in communication with said conduit means for controlling the admission of said pulsating pressure variations from said crankcase to said pulse chamber, activating means connecting said movable member with said valve means for opening said valve means in response to movement of said movable member toward said engaged position and for permitting closing of said valve means in response to movement of said movable member to said retracted position.

10. An engine according to claim 9 wherein said starter mechanism includes a rotatable starter shaft and means for rotating said starter shaft, wherein said movable member comprises a starter pinion carried on said shaft for movement relative to said starter shaft in response to movement of said starter shaft from said retracted position to said engaged position, wherein said valve means comprises a slide valve including a plunger movable between open and closed position and means for biasing said plunger toward the closed position, and wherein said activation means is operably connected to said plunger.

11. An engine according to claim 10 wherein said activating means includes a pivotally mounted lever having one portion located to be engaged by said starter pinion and another portion to engage said plunger.

12. An engine according to claim 11 wherein said means for rotating said starter shaft includes a pulley member drivingly connected to said starter shaft, a pull rope wound on said pulley member and having one end affixed to said pulley member and having a free end which is pulled to rotate said pulley member and thereby rotate said starter shaft.

13. An engine according to claim 11 wherein said means for rotating said starter shaft includes an electric motor drivingly connected to said starter shaft.

14. An engine comprising a combustion chamber, a fuel source, a starter mechanism, fuel conduit means connected in communication with said fuel source for introducing fuel into said combustion chamber, fuel pumping means connected in communication with said fuel conduit means and operable for pumping fuel through said fuel conduit means, drive means for operating said fuel pumping means, and means for operatively connecting said drive means with said fuel pumping means when said starter mechanism is activated.

* * * * *